US005242317A

United States Patent [19]

Watanabe

[11] Patent Number: 5,242,317

[45] Date of Patent: Sep. 7, 1993

[54] CONNECTOR HAVING A TERMINAL CHAMBER INCLUDING RESILIENT FASTENING PORTION FOR HOLDING A TERMINAL

[75] Inventor: Hiroshi Watanabe, Shizuoka, Japan

[73] Assignee: Yazaki Corporation, Tokyo, Japan

[21] Appl. No.: 905,118

[22] Filed: Jun. 26, 1992

[30] Foreign Application Priority Data

Jul. 1, 1991 [JP] Japan ..... 3-050539[U]

[51] Int. Cl.[5] ..... H01R 13/422

[52] U.S. Cl. ..... 439/595

[58] Field of Search ..... 439/595, 83, 744, 871

[56] References Cited

U.S. PATENT DOCUMENTS

| | | | |
|---|---|---|---|
| 3,838,382 | 9/1974 | Sugar | 439/595 |
| 4,124,264 | 11/1978 | Kato et al. | 439/595 |
| 4,695,106 | 9/1987 | Feldman et al. | 439/83 |
| 4,762,507 | 8/1988 | Rudy, Jr. et al. | 439/595 |

FOREIGN PATENT DOCUMENTS

| | | |
|---|---|---|
| 428259 | 5/1991 | European Pat. Off. . |
| 1543480 | 4/1979 | United Kingdom . |
| 2067853A | 7/1981 | United Kingdom . |
| 2144929A | 3/1985 | United Kingdom . |
| WO86/07204 | 12/1986 | World Int. Prop. O. . |

*Primary Examiner*—Neil Abrams

*Attorney, Agent, or Firm*—Armstrong, Westerman, Hattori, McLeland & Naughton

[57] ABSTRACT

A connector has terminals and a housing having terminal chambers in which the terminals are housed. The terminals extend outwardly of the housing. The connector has a resilient fastening strap in each terminal chamber. The resilient strap snugly holds the terminal within the terminal chamber such that the terminal may be aligned in a position thereof in the terminal chamber within a predetermined stroke. The resilient fastening strap may provided in one piece construction with the terminal chamber. The connector also has a weld portion provided on an end portion of the terminal which is welded to an electrode of an external apparatus.

3 Claims, 6 Drawing Sheets

CONNECTOR HAVING A TERMINAL CHAMBER INCLUDING RESILIENT FASTENING PORTION FOR HOLDING A TERMINAL

BACKGROUND OF THE INVENTION

1. Field of the Invention

The present invention relates to a connectors used for making electrical connection in, for example, automobiles.

2. Prior Art

FIG. 6 is a perspective view with a cutaway view in part showing a prior art connector. In the figure, a connector a has a plurality of terminals d and a housing c made of synthetic resin for housing the terminals d. The terminals d have the tip end portions d1 bent at right angles and the other end portions connected with wires e. The tip end portions d1 are formed with projections d2 thereon. The housing c is molded to house both the terminals and the wires in one piece structure. Equipment b has terminals f having tip end portions f1 bent at right angles. The portions f1 are welded to projections d2 that facilitate effective projection welding between the end portions f1 of terminals f and the end portion d1. Welding the portions f1 to the projections d2 provides signal paths for electrical signals between the connector a and the equipment b. The housing c has fastening projections c1 projecting therefrom such that the connector a is assembled to the casing g of the equipment b.

Before molding the aformentioned terminals and housing together, the terminals d having the projections d2 are first formed with the projections d2 thereon and are then bent at right angles to form the tip end portions d1. Then, the wires e are connected to the other end portions of the terminals d. Then, the housing c is molded to house both the terminals and the wires in one piece structure with all the tip end portions d1 lined up. The, the terminals d are welded at the end portions d1 to the tip end portions f of the equipment b. It should be noted that the connector housing c is molded with the wires connected with the terminals. Therefore, the cover of the wire has to be highly heat resistive and therefore is expensive.

Molding the housing c in one piece construction with a plurality of terminals enables the terminals to be accurately aligned in a line. Meanwhile, the terminals f are often not quite accurately aligned; some are little too far from the housing b and some are little too close to the housing b. Therefore, the terminals d may not always be in contact with corresponding terminals f when the connector is assembled to the casing g. Thus, individual tailoring is required to align the distances of terminals f projecting from the housing before the terminals d are welded to the terminals f so as to ensure that each of the terminals d is properly in contact with corresponding terminal f. This alignment operation is time consuming.

SUMMARY OF THE INVENTION

An object of the present invention is to provide a connector where the positions of respective terminals are aligned relative to the housing thereof so as to offset the positional errors of electrodes of the equipment to which the respective terminals of the connector are to be connected. Another object of the invention is to provide a connector whose terminals may be promptly welded to the terminals or electrodes of the equipment to which the connector is to be assembled.

A connector has terminals and a housing having terminal chambers in which the terminals are housed. The terminals extend outwardly of the housing. The connector has a resilient fastening strap in each terminal chamber. The resilient fastening strap snugly holds the terminal within the terminal chamber such that the terminal may be aligned a position thereof in the terminal chamber within a predetermined stroke. The resilient fastening strap is provided within the terminal chamber in one piece construction with the terminal chamber wall. The respective terminal has a weld portion provided on a tip end portion thereof which is welded to an electrode of external equipment.

BRIEF DESCRIPTION OF THE DRAWINGS

Features and other objects of the present invention will be more apparent from the detailed description of the preferred embodiments with reference to the accompanying drawings in which.

DETAILED DESCRIPTION OF THE PREFERRED EMBODIMENT

Figure 1:
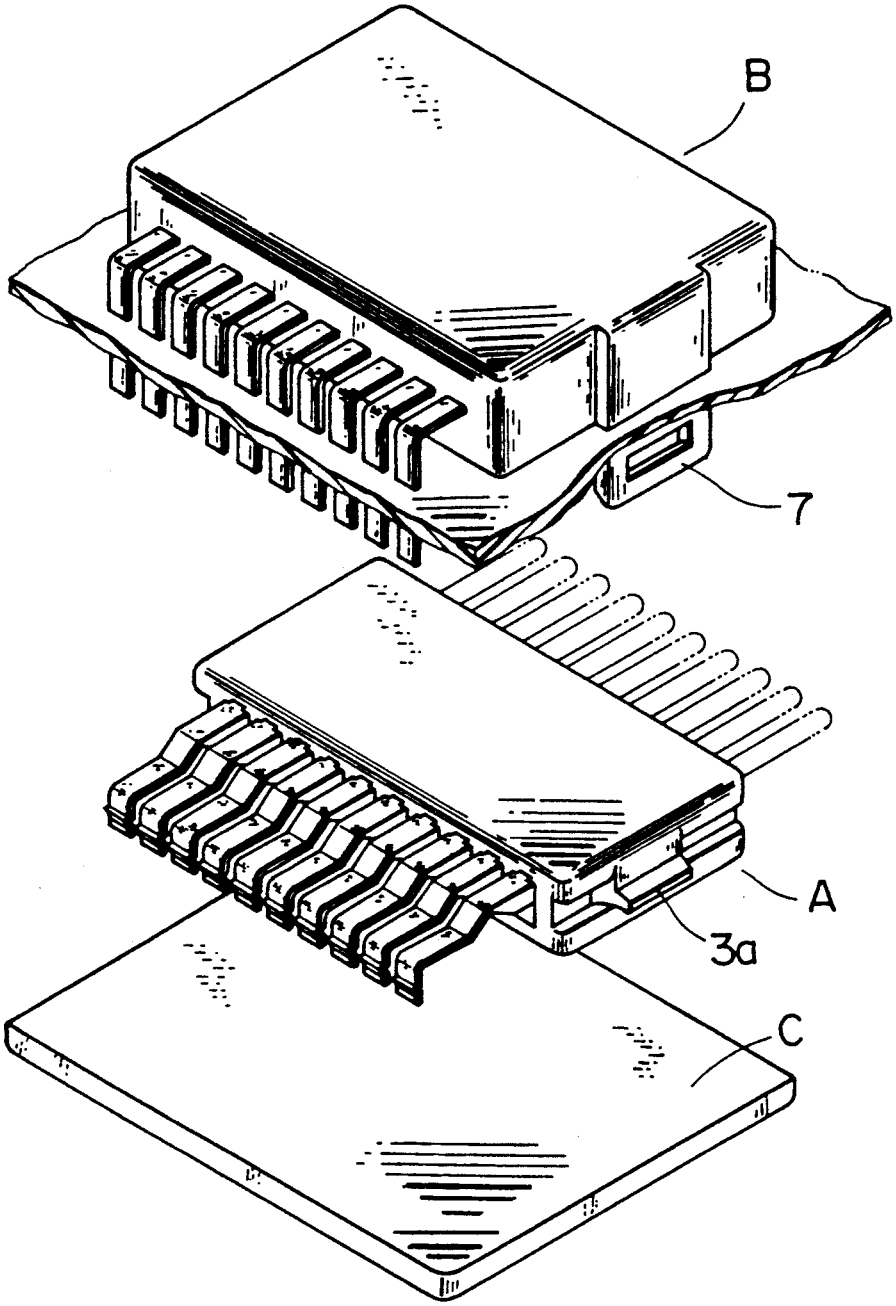
FIG. 1 is an exploded perspective view of an embodiment of a connector according to the invention.
Figure 2:
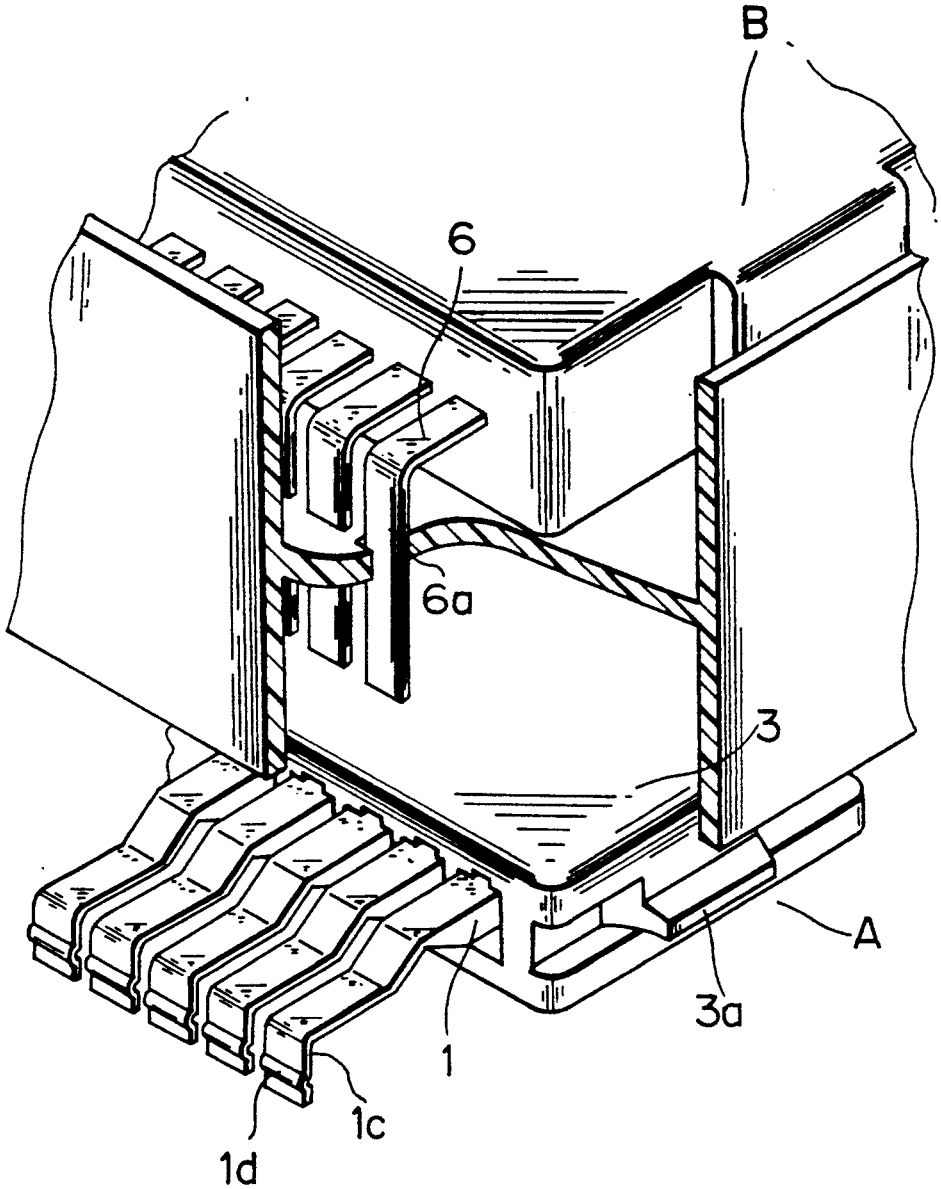
FIG. 2 is a perspective view of essential part of FIG. 1 showing a cutaway view in part.
Figure 3A:
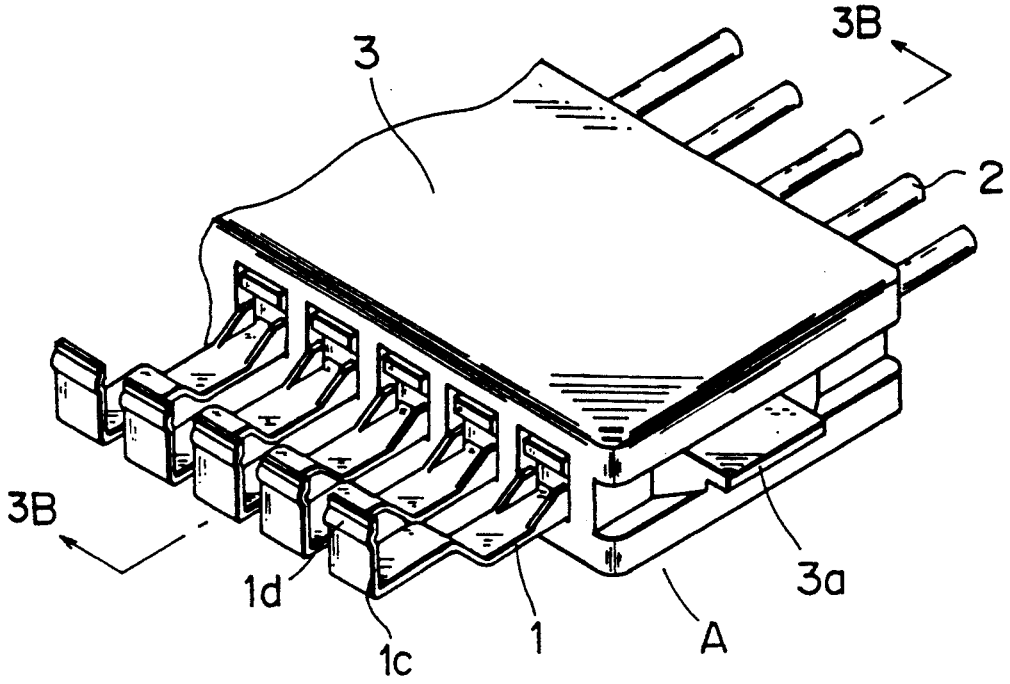
FIG. 3A is a fragmentary perspective view of the connector A of FIG. 1 showing an essential part.
Figure 3B:
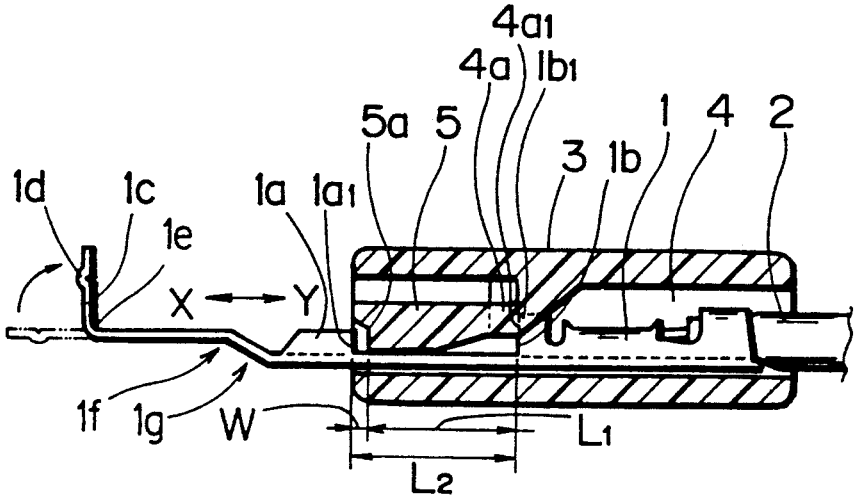
FIG. 3B is a cross-sectional side view of the connector A of FIG. 1 taken along the lines B–B'.
Figure 4:
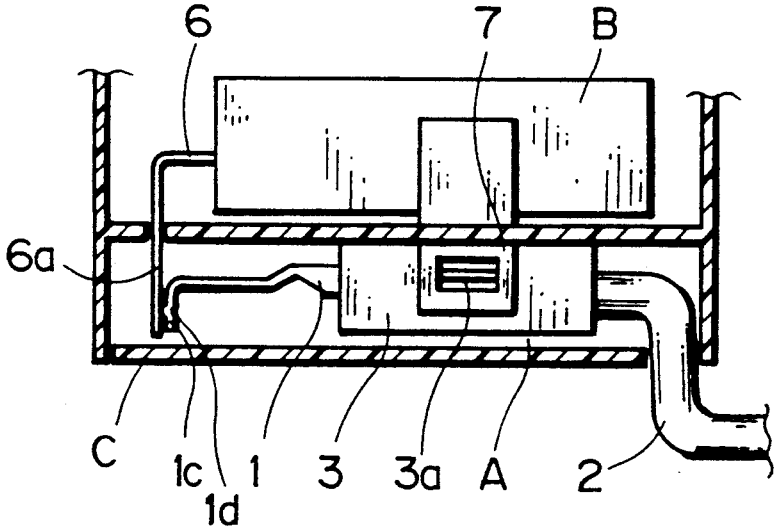
FIG. 4 shows the connector A of FIG. 1 assembled to equipment B with the fastening projection 3*a* engaging the resilient fastening strap 7 of the equipment B.

FIG. 1 is an exploded perspective view of an embodiment of a connector according to the present invention. FIG. 2 is a perspective view with a cutaway view in part, showing an essential part of FIG. 1. A connector A has a housing 3 on which fastening projections 3*a* are provided (only one being shown.) The fastening projections 3*a* engage fastening straps 7 of equipment B as shown in FIG. 4 when the connector A is assembled to the equipment B. The fastening straps 7 are formed to have some resiliency for easy and secure engagement between the fastening straps 7 and the fastening projections 3*a*. An undercover C is attached to the equipment B after the connector A is assembled to the equipment B. FIG. 3A is a perspective view of the connector A showing an essential part. FIG. 3B is a cross-sectional side view of the connector A taken along the lines B–B'. In FIG. 3B, the terminal 1 is bent at 1*f* and 1*g* midway the front end portion of the terminal 1, and is also bent at 1*e* at right angles to form a tip end portion 1*c*. The tip end portion 1*c* is formed with a weld portion 1*d* positioned thereon which facilitates later described welding operation. The other end portion of the terminal 1 is crimped to a wire 2. The housing 3 is made of synthetic resin and has terminal chambers 4 and resilient fastening straps 5 integrally continuous with the upper wall of the terminals chambers 4. The resilient fastening strap 5 serves to resiliently holds the terminals in position within the terminals chamber 4 when the terminal is inserted into the chamber. The terminal 1 has a fastening strap 1*a* and a stabilizer 1*b* spaced apart from the fastening strap 1*a*. The distance L2 between a rear end 1*a*1 of the fastening strap 1*a* and a front end 1*b*1 of the stabilizer 1*b* is greater than the distance L1 between the rear end 4*a*1 of the fastening strap 5 to the tip end 5*a*. Thus, the terminal 1 is snugly slidable within the terminals chamber 4 by a stroke W i.e., the difference between the distances L1 and L2.

Figure 5A:
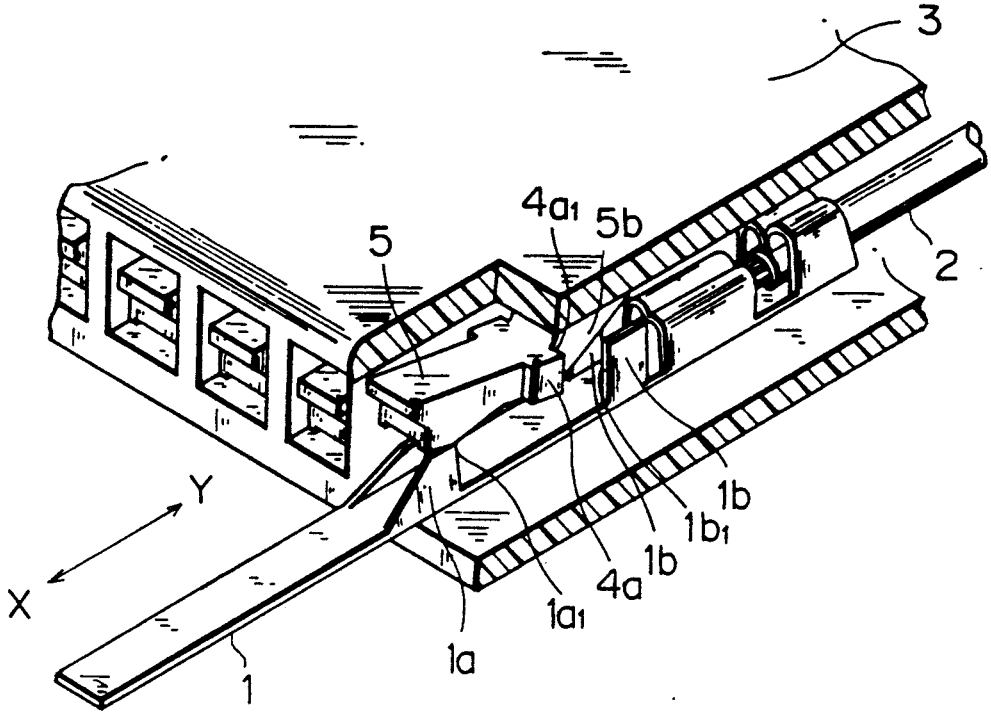
FIG. 5A shows the terminal 1 being inserted into the housing 3, and the resilient fastening strap 5 that has climbed on the top of the fastening strap 1*a* of terminal 1.
Figure 5B:
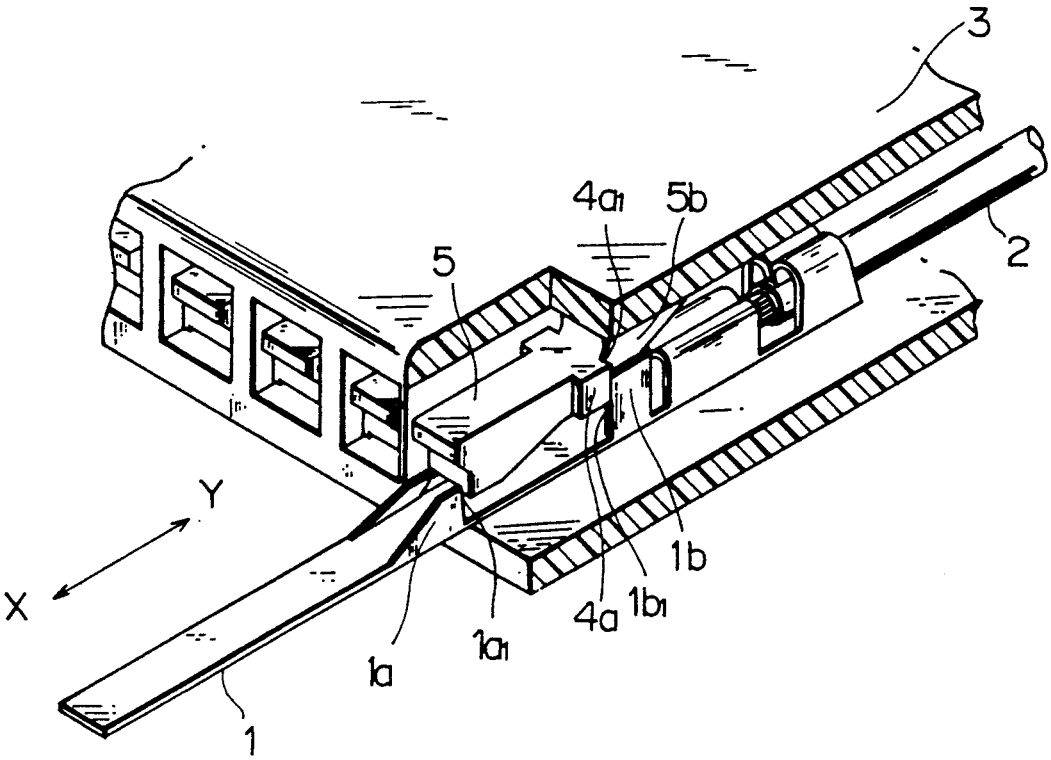
FIG. 5B shows the resilient fastening strap 5 that has just dropped from the top of the fastening strap 1*a* as the terminal 1 in FIG. 5A is further advanced.
Figure 6:
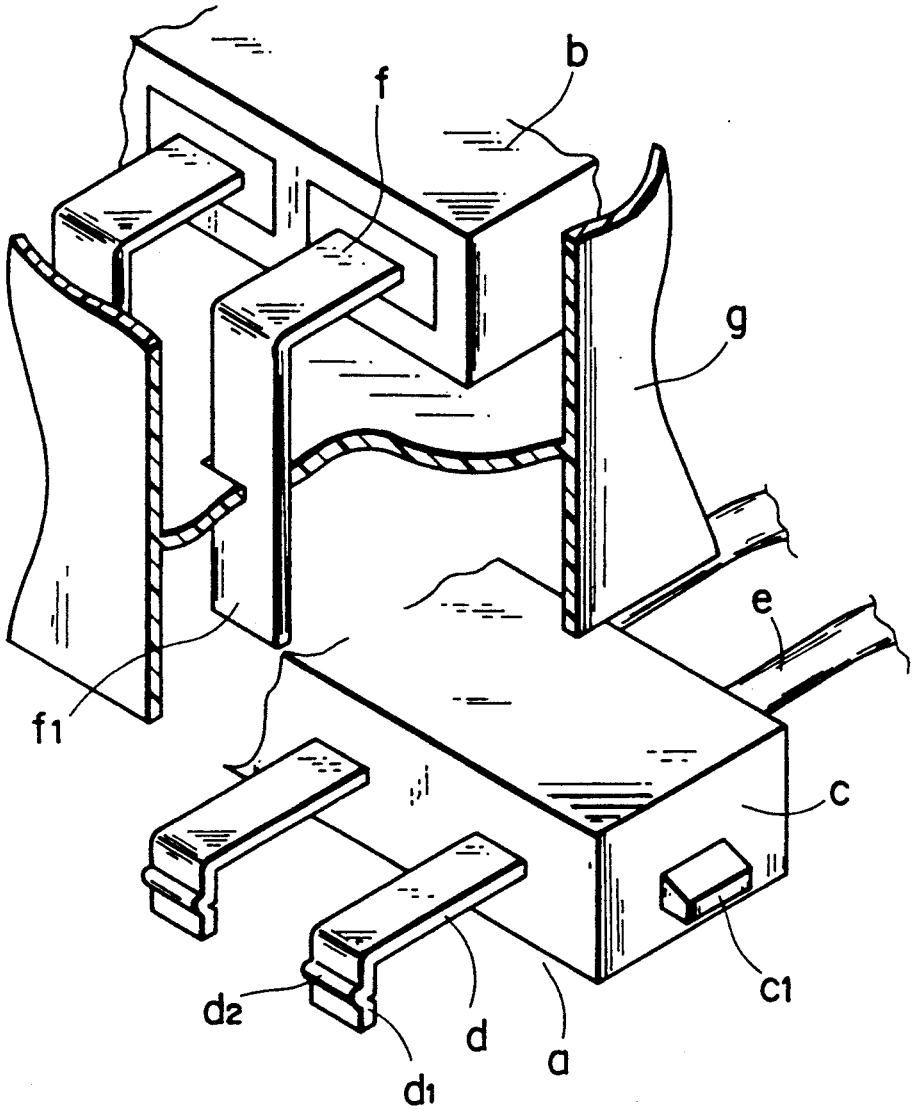
FIG. 6 PRIOR ART
FIG. 6 is a perspective view of a prior art connector showing a cutaway view in part.

The terminal 1 is initially straight such that the terminal 1 is smoothly inserted into the housing. When assembling the connector A, the terminal 1 is first inserted into the housing 3 in the direction of X as shown in FIG. 5A. FIG. 5A shows the terminal 1 being inserted into the housing and the resilient fastening strap 5 that has climbed on the top of the fastening strap 1*a* of terminal 1. As the terminal advances through the terminal chamber 4, the beveled portion of the fastening strap 1*a* pushes the resilient fastening strap 5 up so that the resilient fastening strap 5 climbs the beveled portion of the fastening strap 1*a* to the top thereof. Thus, the resilient fastening strap 5 yieldably deflects upwardly allowing the terminal 1 to further advance. As the terminal 1 is further advanced, the resilient fastening strap 5 drops from the top of the fastening strap 1*a* to return to an original position of the strap 5 in the housing 3 as shown in FIG. 5B. Immediately after the resilient fastening strap 5 returns to its original position, the rear end 1*a*1 of fastening strap 1*a* abuts the tip end 5*a* of the resilient fastening strap 5 so that the terminal 1 is now prevented from moving in the direction of Y. The terminal 1 is further inserted into the housing until the front end 1*b*1 of stabilizer 1*b* abuts the rear end 4*a*1 of the resilient strap 5, which prevents the terminal 1 from moving further into the housing 3 in the direction of X. The opposing stabilizers 1*b* hold a rear portion 5*b* of the resilient fastening strap 5 in a sandwiched relation so as to maintain the terminal 1 in position.

As shown in FIG. 3B, the terminal 1 is then formed with the weld portion 1*d* on the tip end portion thereof. The terminal 1 is then bent at 1*f* and 1*g* to form the terminal into a proper shape. The terminal 1 is then further bent at 1*e* to form the tip end portions 1*c* as depicted by solid lines in FIG. 3B. The terminal 1 is snugly held in the terminal chamber 4 by the urging force of the fastening strap 5.

As shown in FIG. 4, the connector A is assembled to the equipment B by means of the fastening projections 3*a* engaging the resilient fastening straps 7 of the equipment B. Thereafter, the terminals 1 are aligned their longitudinal positions back and forth through the difference W such that each of the terminals 1 is properly in contact with the tip end portion of the corresponding terminal 6. After having been aligned their positions relative to the terminals 6, the terminals 1 are welded at 1*d* to the terminals 6.

What is claimed is:

1. A connector having at least one terminal, comprising:

a housing adapted to receive at least one terminal, said housing having a lower wall, an upper wall, and sidewalls, said sidewalls bounding a plurality of terminal chambers, and said terminal chamber having a first, open end adapted to receive a terminal and a second end which is adapted to permit passage of the inserted terminal after the inserted terminal has been inserted into said first, open end of said terminal chamber;

at least one terminal adapted to be inserted into said housing, each said terminal having a bendable tip, a rear portion adapted to be fixedly attached to a wire, a main body portion having a fastening strap and a stabilizer, said main body portion being disposed between said bendable tip and said rear portion; said bendable tip having a protruding weld portion which is adapted to be welded to a terminal of an electronic device for electrical connection therewith; and a rear end of said fastening strap and a front end of said stabilizer being disposed a selected distance apart and extending transversely to said main body portion, said fastening strap having a upstanding front end and an upstanding rear end;

resilient fastening means disposed within each of said plurality of terminal chambers for snugly holding said terminal within said terminal chamber, said resilient fastening means having a first end connected to said upper wall and having a second end which is resiliently biased toward said lower wall and which is movable toward said upper wall by the terminal when said bendable tip of said terminal is being inserted into said housing; said second end of said resilient fastening means having a tip adapted for enagement with said upstanding rear end of said fastening strap and a rear abutment portion adapted for engagement with said stabilizer of said terminal; said tip of said resilient fastening means and said rear abutment portion of said resilient fastening means being disposed a fixed distance apart which is less than said selected distance, such that said resilient fastening means can be received between said rear end of said fastening strap and said front end of said stabilizer; and wherein upon further advancement of said terminal into said terminal chamber, said resilient fastening means being resiliently urged adjacent said main body portion of said terminal between said rear end of said fastening strap and said front end of said stabilizer; advancement of said terminal into said housing being limited by abutment of said front end of said stabilizer with said rear abutment portion of said second end of said resilient fastening means; and wherein when said resilient fastening means is received between said rear end of said fastening strap and said front end of said stabilizer, said bendable tip of said terminal projects out of said second end of said terminal chamber, and retracting movement of said tip end into said second end of said terminal chamber is prevented by abutment of said upstanding rear end of said fastening strap with said tip of second end of said resilient fastening means;

wherein said bendable tip of said temrinal is held in an aligned position relative to said housing in a direction in which said terminal is inserted into said terminal chamber.

2. A connector according to claim 1, wherein said resilient fastening means is formed on said upper wall of said terminal chamber integrally with said upper wall.

3. A connector according to claim 2, wherein said fastening strap of said terminal has a first, leading fastening portion which is beveled to facilitate advancement of said fastening strap into said terminal chamber against said resilient fastening means, said beveled portion pushing away said second end of said resilient fastening means when said terminal is inserted in a first direction into said housing so that said resilient fastening means yieldably deflects toward said upper wall of said housing, whereby said resilient fastening means engages said fastening strap to prevent said terminal from moving out of said housing in a second direction opposite to said first direction when said resilient fastening means resiliently regains an original position thereof after said fastening strap of said terminal has advanced past said resilient fastening means.

* * * * *